US010627148B2

(12) United States Patent
Dai

(10) Patent No.: US 10,627,148 B2
(45) Date of Patent: Apr. 21, 2020

(54) PORTABLE COLD STORAGE BOX

(71) Applicant: Shenzhen Dezhongxing Technology Co., Ltd., Shenzhen, Guangdong (CN)

(72) Inventor: Pinling Dai, Guangdong (CN)

(73) Assignee: Shenzhen Dezhongxing Technology Co., Ltd., Shenzhen (CN)

( * ) Notice: Subject to any disclaimer, the term of this patent is extended or adjusted under 35 U.S.C. 154(b) by 0 days.

(21) Appl. No.: 16/049,788

(22) Filed: Jul. 30, 2018

(65) Prior Publication Data

US 2019/0316825 A1 Oct. 17, 2019

(30) Foreign Application Priority Data

Apr. 13, 2018 (CN) ..... 2018 2 0533215 U

(51) Int. Cl.

| | |
|---|---|
| ***F25D 3/00*** | (2006.01) |
| ***F25D 31/00*** | (2006.01) |
| *F28D 20/02* | (2006.01) |
| *B65D 21/02* | (2006.01) |
| *F25D 3/08* | (2006.01) |

(Continued)

(52) U.S. Cl.

CPC ..... *F25D 3/00* (2013.01); *F25D 31/002* (2013.01); *B65D 21/022* (2013.01); *B65D 21/0202* (2013.01); *B65D 81/18* (2013.01); *B65D 81/3813* (2013.01); *F25D 3/08* (2013.01); *F25D 2303/082* (2013.01); *F25D 2303/0821* (2013.01); *F25D 2303/0832* (2013.01); *F25D 2303/0843* (2013.01); *F25D 2303/0844* (2013.01); *F25D 2303/08222* (2013.01); *F25D 2331/804* (2013.01); *F28D 20/02* (2013.01)

(58) Field of Classification Search

CPC ..... F25D 3/08; F25D 2303/0843; F25D 2303/0844; F25D 2331/804; F25D 2303/082; F25D 2303/0821; F25D 2303/08222; F25D 2303/0832; F28D 20/02; B65D 81/18; B65D 81/3813; B65D 21/0202; B65D 21/022

See application file for complete search history.

(56) References Cited

U.S. PATENT DOCUMENTS 3,093,259 A * 6/1963 Morrison ..... B65D 11/1873 220/592.25
3,160,307 A * 12/1964 Morrison ..... B65D 11/1873 220/4.33

(Continued)

*Primary Examiner* — Frantz F Jules
*Assistant Examiner* — Lionel Nouketcha

(57) ABSTRACT

The present disclosure relates to a portable cold storage box having at least six identical square cold storage pieces capable of being put together to form a cuboid or cubic box. A through-hole is provided in the middle of each square cold storage piece. The periphery of each through-hole has one surface formed with a recess and an opposite surface formed with a step-shaped protrusion which can be snapped in a corresponding recess. Engageable tooth-shaped teeth are formed on opposite sides of the square cold storage pieces. A refrigerant is stored inside the square cold storage pieces in a sealed manner. The portable cold storage box of the present disclosure is advantageous in that it does not require a power source. It is easy to assemble, and after disassembling, the disassembled pieces can be quickly stacked up without being scattered around.

9 Claims, 3 Drawing Sheets

(51) Int. Cl.
*B65D 81/18* (2006.01)
*B65D 81/38* (2006.01)

(56) References Cited

U.S. PATENT DOCUMENTS

| | | | | | |
|---|---|---|---|---|---|
| 3,474,843 | A * | 10/1969 | Maris | B65D 21/023 | 206/599 |
| 4,649,667 | A * | 3/1987 | Kitograd | B65D 11/1873 | 220/4.28 |
| 6,935,533 | B2 * | 8/2005 | Clausen | B65D 1/20 | 222/143 |
| 7,963,397 | B2 * | 6/2011 | Seagle | B65D 19/18 | 206/600 |
| 9,751,682 | B2 * | 9/2017 | Mayer | B65D 81/3825 | |
| 2010/0326993 | A1 * | 12/2010 | Mayer | B65D 81/3825 | 220/592.27 |
| 2011/0168727 | A1 * | 7/2011 | Williams | F25D 3/08 | 220/592.26 |

* cited by examiner

PORTABLE COLD STORAGE BOX

CROSS REFERENCE TO RELATED APPLICATIONS

The present application claims the benefit of Chinese Utility Model Application No. 201820533215.3 filed on Apr. 13, 2018. All the above are hereby incorporated by reference.

TECHNICAL FIELD

The present disclosure relates to a daily necessity, and in particular to a portable cold storage box which does not require power source, easy to assemble, and after disassembling, the disassembled pieces can be quickly stacked up without being scattered around.

BACKGROUND

The mini fridge currently on the market, i.e., the thermoelectric cooling device which adopts Peltier effect and direct refrigeration by semiconductor, has the characteristics of low power consumption, no bulky compressor, no pollution of noise and Freon, long life, cute appearance, petite size, and portability. It is suitable for both indoor and outdoor use. It is particularly suitable for use by travelers and field workers. It has the function of heating and cooling. In summer, its cooling function can be utilized to keep beverage cold. In winter, its heating function can be utilized to warm up milk, beverage, bread and other food. This kind of product is getting popular among fashionable youth. However, this kind of mini fridge must be used together with power source, and manipulating electric wire and plug can be troublesome even though there is convenient socket such as USB, etc. For travelers and field workers, the fridge cannot be used without external power supply. Since the fridge can only work with power supply, the promotion and application of this kind of mini fridge is restricted.

SUMMARY

An object of the present disclosure is to provide a portable cold storage box which is advantageous in that it does not require power source. It is easy to assemble, and after disassembling, the disassembled pieces can be quickly stacked up without being scattered around.

The object of the present disclosure can be realized by means of the following technical measures. A portable cold storage box may include at least six identical square cold storage pieces capable of being put together to form a cuboid or cubic box. A through-hole may be formed in the middle of each square cold storage piece. A step-shaped protrusion may be formed on one surface of a periphery of the through-hole, and a recess may be formed on an opposite surface of the periphery of the through-hole. The step-shaped protrusion of one square cold storage piece can be snapped in the recess of another square cold storage piece. Engageable tooth-shaped teeth may be formed on opposite sides of the square cold storage pieces. A refrigerant may be stored inside the square cold storage pieces in a sealed manner.

In a preferred embodiment, two adjacent sides of each square cold storage piece may be respectively formed with two pairs of identical teeth.

In a preferred embodiment, the through-hole can be a circular hole having a center located at the center of the square cold storage piece.

In a preferred embodiment, the step-shaped protrusion may be square-shaped in plan view and may have a dimension equal to or slightly larger than that of the recess.

In a preferred embodiment, the step-shaped protrusion may have a rounded edge.

In a preferred embodiment, one side of each square cold storage piece may be provided with a filling inlet for filling the refrigerant in the square cold storage piece.

In a preferred embodiment, the tooth-shaped teeth may have a depth equal to the thickness of the square cold storage piece.

In a preferred embodiment, the through-hole may be dimensioned to allow a user's finger to move in and out of the through-hole.

In a preferred embodiment, each side of the square cold storage piece may have a length not less than 70 mm.

When in use, the portable cold storage box of the present disclosure can be put together to form a cuboid or cubic box by means of the tooth-shaped sides, and then beverage, fruit and other food can be stored inside the box. In this way, the beverage and food can be kept cold and fresh during an outing. The through-holes formed in the middle of the square cold storage pieces can (i) facilitate identification of the kind of food stored inside the box when it is in a closed position, and (ii) allow a user to insert fingers through the through-holes and pull the box apart by force during disassembling. The square cold storage pieces can be stacked up to reduce the space needed during transportation or when they are placed inside a refrigerator for cooling. The recess formed on one surface and the step-shaped protrusion formed on the opposite surface and snappable in the recess can facilitate quick and neat stacking up of the cold storage pieces so that they can be moved in one piece without scattering around.

DETAILED DESCRIPTION

The portable cold storage box of the present disclosure is further described in detail with reference to a number of embodiments and the accompanying figures.

Figure 1:
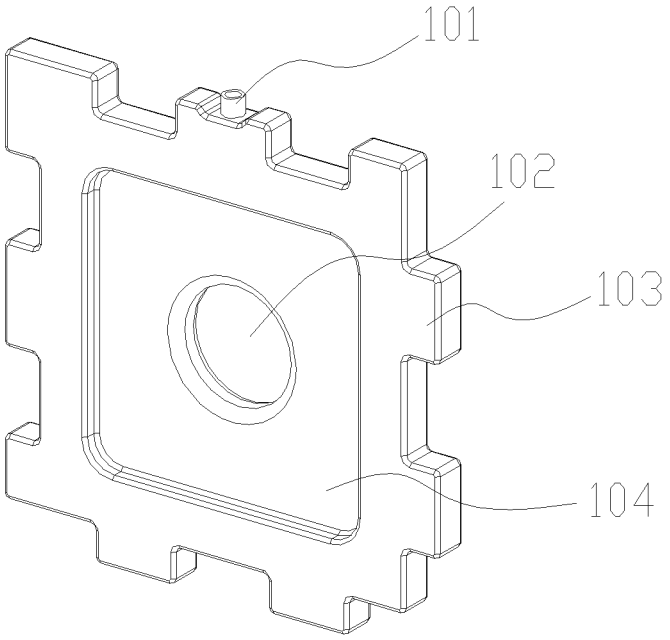
FIG. 1 is a schematic diagram showing a front side of a square cold storage piece according to an embodiment of the present disclosure.
Figure 2:
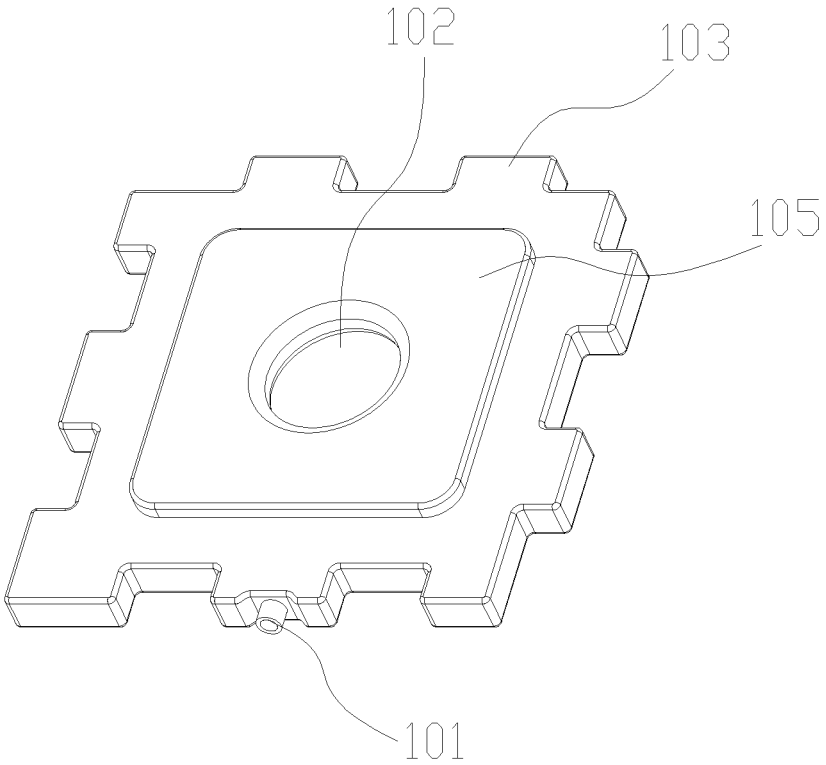
FIG. 2 is a schematic diagram showing a rear side of the square cold storage piece according to an embodiment of the present disclosure.

A portable cold storage box, as shown in FIGS. 1 and 2, may include at least six identical square cold storage pieces 100 capable of being put together to form a cuboid or cubic box. A through-hole 102 may be formed in the middle of each square cold storage piece 100. A step-shaped protrusion 105 may be formed on one surface of a periphery of each through-hole 102, and a recess 104 may be formed on an opposite surface of the periphery of each through-hole 102. The step-shaped protrusion 105 of one square cold storage piece can be snapped in the recess 104 of another square cold storage piece. Engageable tooth-shaped teeth 103 may be formed on opposite sides of the square cold storage pieces 100. A refrigerant may be stored inside the square cold storage pieces 100 in a sealed manner.

Figure 3:
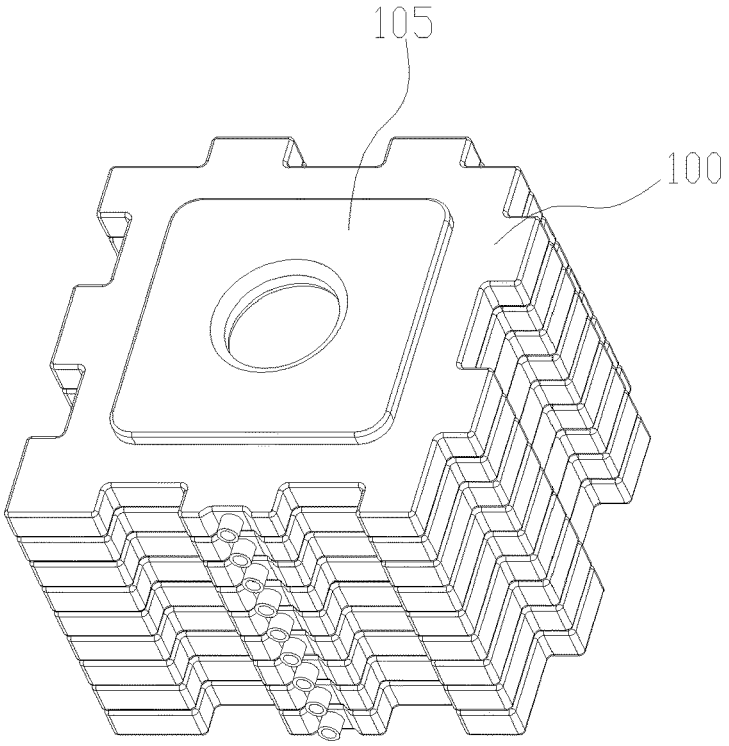
FIG. 3 is a schematic diagram showing a number of square cold storage pieces being stacked up according to an embodiment of the present disclosure.
Figure 4:
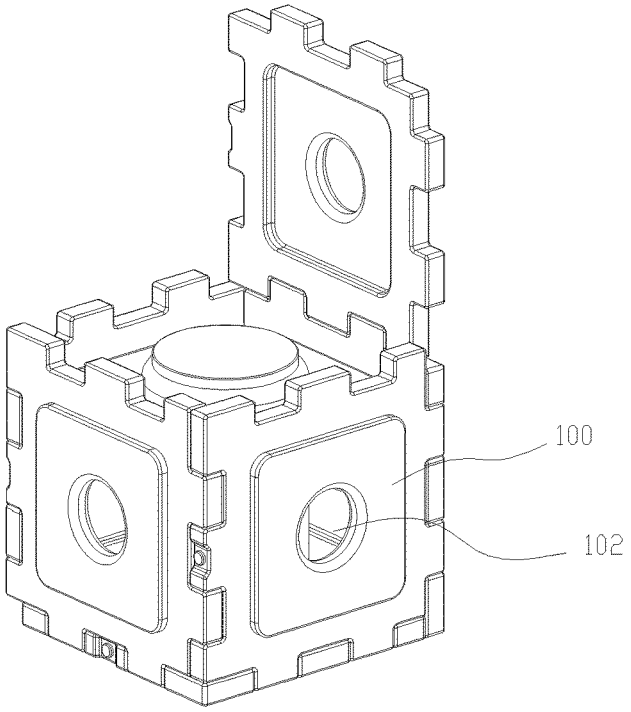
FIG. 4 is a schematic diagram showing an assembled and opened cubic box according to an embodiment of the present disclosure.
Figure 5:
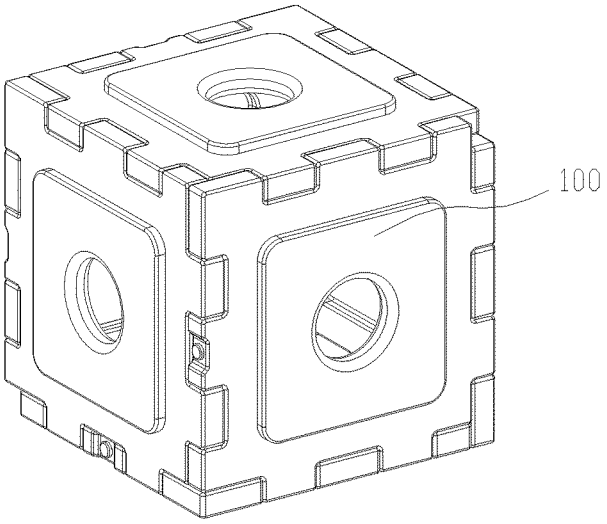
FIG. 5 is a schematic diagram showing an assembled and closed cubic box according to an embodiment of the present disclosure.
Figure 6:
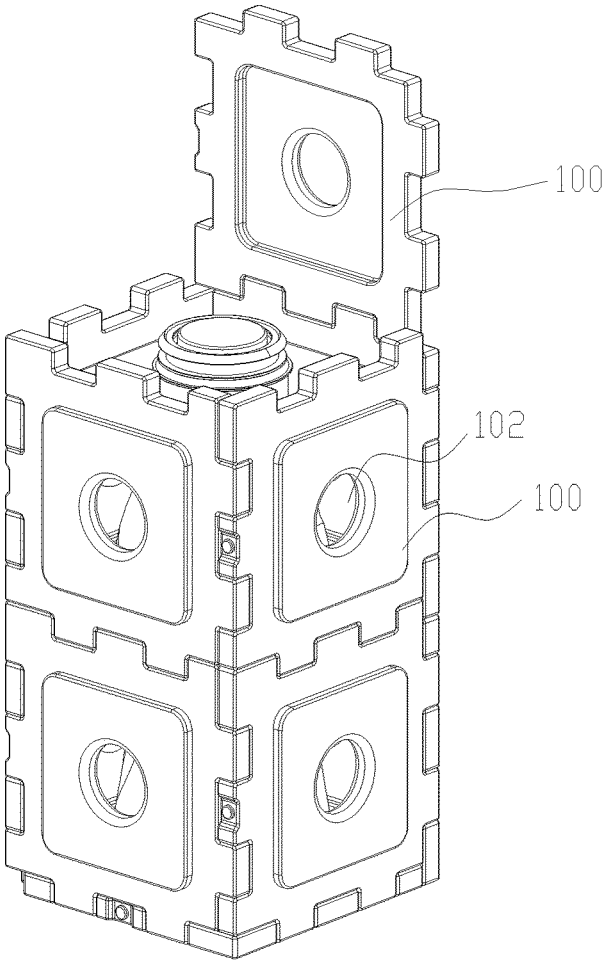
FIG. 6 is a schematic diagram showing an assembled and opened cuboid box according to an embodiment of the present disclosure.

When in use, the portable cold storage box of the present disclosure can be put together to form a cubic box as shown in FIGS. 4 and 5, or a cuboid box as shown in FIG. 6 by means of the tooth-shaped sides 103. Beverage, fruit and other food can then be stored inside the box so that the beverage and food can be kept cold and fresh during an outing. The through-holes 102 formed in the middle of the square cold storage pieces 100 can (i) facilitate identification of the kind of food stored inside the box when it is in a closed position, and (ii) allow a user to insert fingers through the through-holes and pull the box apart by force during disassembling. The square cold storage pieces 100 can be stacked up, as shown in FIG. 3, in order to reduce the space needed during transportation or when they are placed inside a refrigerator for cooling. The recess 104 formed on one surface and the step-shaped protrusion 105 formed on the opposite surface for snapping in the recess 104 can facilitate quick and neat stacking up of the cold storage pieces so that they can be moved in one piece without being scattered around.

In the portable cold storage box of the present disclosure shown in FIGS. 1 to 2 and on the basis of the previous technical scheme, two adjacent sides of each square cold storage piece 100 may be formed respectively with two pairs of identical teeth so that a bigger box can be assembled. If a smaller box is to be assembled, then the two opposite sides of each square cold storage piece may also be formed respectively with two pairs of identical teeth.

In the portable cold storage box of the present disclosure shown in FIGS. 1 to 2 and on the basis of the previous technical scheme, the through-hole 102 can be a circular hole having a center located at the center of the square cold storage piece 100. This structure can facilitate processing. It can also facilitate massive transportation by passing a rope or a rod through the through-holes.

In the portable cold storage box of the present disclosure shown in FIGS. 1 to 2 and on the basis of the previous technical scheme, the step-shaped protrusion 105 may be square-shaped in plan view and may have a dimension which is equal to or slightly larger than that of the recess 104. This can facilitate engagement of the two pairs of teeth and can also facilitate stacking up of the square cold storage pieces in any orientation.

In the portable cold storage box of the present disclosure shown in FIGS. 1 to 2 and on the basis of the previous technical scheme, the step-shaped protrusion 105 may be formed with a rounded edge. This can facilitate the snapping of the step-shaped protrusion 105 in the recess 104. Of course, the recess 104 may also be formed with a rounded edge.

In the portable cold storage box of the present disclosure shown in FIGS. 1 to 2 and on the basis of the previous technical scheme, one side of each square cold storage piece 100 may be provided with a filling inlet 101 for filling the refrigerant in a space inside the square cold storage piece 100. After filling the refrigerant, the filling inlet 101 may be sealed. The sealed filling inlet should not exceed the side of the square cold storage piece 100.

In the portable cold storage box of the present disclosure shown in FIGS. 1 to 2 and on the basis of the previous technical scheme, the teeth at the tooth-shaped side 103 may have a depth equal to the thickness of the square cold storage piece 101 so that the box can have a nice appearance after assembling.

In the portable cold storage box of the present disclosure shown in FIGS. 1 to 2 and on the basis of the previous technical scheme, the through-hole 102 may be dimensioned to allow a user's finger to move in and out of the through-hole in order to facilitate manual operation.

In the portable cold storage box of the present disclosure shown in FIGS. 1 to 2 and on the basis of the previous technical scheme, each side of the square cold storage piece 100 may have a length not less than 70 mm.

The above is a description that assists the understanding of the portable cold storage box of the present disclosure. The embodying of the portable cold storage box of the present disclosure is not limited by the above-described embodiments. Any alteration, modification, substitution, combination, and addition that do not depart from the principle of the portable cold storage box of the present disclosure should be equivalent replacements that are encompassed within the scope of protection of the appended claims.

What is claimed is:

1. A portable cold storage box, comprising at least six identical square cold storage pieces capable of being put together to form a cuboid or cubic box, a through-hole formed in a middle of each square cold storage piece, a step-shaped protrusion formed on one surface of a periphery of the through-hole, a recess formed on an opposite surface of the periphery of the through-hole, the step-shaped protrusion of one square cold storage piece being snappable in the recess of another square cold storage piece, engageable tooth-shaped teeth formed on opposite sides of the square cold storage pieces, and a refrigerant stored inside the square cold storage pieces in a sealed manner.

2. The portable cold storage box according to claim 1, wherein two adjacent sides of each square cold storage piece are respectively formed with two pairs of identical teeth.

3. The portable cold storage box according to claim 1, wherein the through-hole is a circular hole having a center located at a center of the square cold storage piece.

4. The portable cold storage box according to claim 1, wherein the step-shaped protrusion is square-shaped in plan view and has a dimension which is equal to or slightly larger than that of the recess.

5. The portable cold storage box according to claim 1, wherein the step-shaped protrusion is formed with a rounded edge.

6. The portable cold storage box according to claim 1, wherein one side of each square cold storage piece is provided with a filling inlet for filling the refrigerant inside the square cold storage piece.

7. The portable cold storage box according to claim 1, wherein the teeth have a depth equal to a thickness of the square cold storage piece.

8. The portable cold storage box according to claim 1, wherein the through-hole is dimensioned to allow a user's finger to move in and out of the through-hole.

9. The portable cold storage box according to claim 1, wherein each side of the square cold storage piece has a length not less than 70 mm.

* * * * *